US010905933B2

(12) United States Patent
Messner et al.

(10) Patent No.: US 10,905,933 B2
(45) Date of Patent: Feb. 2, 2021

(54) PREDICTIVE GOLF AID

(71) Applicant: Shots to Hole Pty Ltd, Rossana (AU)

(72) Inventors: Paul Messner, Rosanna (AU); Stuart Leong, Tylden (AU)

( * ) Notice: Subject to any disclaimer, the term of this patent is extended or adjusted under 35 U.S.C. 154(b) by 0 days.

(21) Appl. No.: 14/616,272

(22) Filed: Feb. 6, 2015

(65) Prior Publication Data

US 2015/0258409 A1 Sep. 17, 2015

Related U.S. Application Data

(63) Continuation of application No. 13/504,983, filed as application No. PCT/AU2010/001451 on Oct. 29, 2010, now abandoned.

(30) Foreign Application Priority Data

Oct. 30, 2009 (AU) ..... 2009905324

(51) Int. Cl.

| | |
|---|---|
| ***A63F 9/24*** | (2006.01) |
| ***A63B 69/36*** | (2006.01) |
| ***A63B 71/06*** | (2006.01) |
| ***A63B 24/00*** | (2006.01) |
| ***A63B 57/00*** | (2015.01) |

(52) U.S. Cl.

CPC ..... *A63B 69/36* (2013.01); *A63B 24/0003* (2013.01); *A63B 24/0062* (2013.01); *A63B 57/00* (2013.01); *A63B 71/0669* (2013.01); *A63B 24/0075* (2013.01); *A63B 2024/0056* (2013.01)

(58) Field of Classification Search

CPC . A63B 63/00; A63B 24/0021; A63B 69/3691; A63B 2024/0043; A63B 2243/0029; A63B 2053/005; A63B 2069/3605; A63B 2071/0691; A63B 2220/13; A63B 2220/20; A63B 69/36; A63B 71/0669; A63B 60/42; A63B 2024/0025; A63B 2024/0028; A63B 2024/0056; A63B 2102/32; A63B 2220/12; A63B 2225/50; A63B 57/00; A63B 60/46; G06N 5/02; G06N 7/005; G09B 19/0038

See application file for complete search history.

(56) References Cited

U.S. PATENT DOCUMENTS

| | | | |
|---|---|---|---|
| 5,558,333 | A | 9/1996 | Kelson et al. |
| 6,176,789 | B1 | 1/2001 | Kluttz et al. |
| 6,697,820 | B1 | 2/2004 | Tarlie |

(Continued)

FOREIGN PATENT DOCUMENTS

| | | |
|---|---|---|
| AU | 61959/00 | 3/2001 |
| EP | 1206306 | 5/2002 |

(Continued)

*Primary Examiner* — Justin L Myhr

(74) *Attorney, Agent, or Firm* — Benjamin Aaron Adler

(57) ABSTRACT

The invention provides a golf improvement aid having a plurality of inputs, a golf improvement aid having at least one input for receiving inputted data of a real game of golf of a user, a collator for receiving and automatically collating the input from the input means on a plurality of holes in the game of golf; a determinator for determining a model for the particular user based on the collated input for a plurality of holes in one or more games of golf of the user; and one or more outputs for outputting results or information based on results from the determined model.

23 Claims, 17 Drawing Sheets

(56) References Cited

U.S. PATENT DOCUMENTS

| | | | |
|---|---|---|---|
| 7,010,550 | B2 | 3/2006 | Tarlie |
| 7,192,359 | B1 | 3/2007 | Lundgren et al. |
| 2002/0072815 | A1 | 6/2002 | McDonough et al. |
| 2003/0191547 | A1 | 10/2003 | Morse |
| 2004/0162125 | A1 | 8/2004 | Tarlie |
| 2008/0200284 | A1 | 8/2008 | Doherty |

FOREIGN PATENT DOCUMENTS

| | | |
|---|---|---|
| SE | 9902773 | 1/2001 |
| WO | 0110518 | 2/2001 |
| WO | 2008097601 | 8/2008 |

Compare: Last Round

| Distance | 0 - 10m | >10 - 20m | >20 - 40m | >40 - 60m | >60 - 80m | >80 - 100m |
|---|---|---|---|---|---|---|
| Per Round | 4.0 | 6.0 | 1.0 | 2.0 | 1.0 | 1.0 |
| Shots to Hole | ✗3.0 shots | ✓2.3 shots | ✓2.0 shots | ✓2.5 shots | ✗3.0 shots | 3.0 shots |
| Dispersion | ✗8.1m | ✓2.2m | ✓2.4m | ✓2.1m | ✓4.6m | ✓4.6m |

Benchmark: Best 1/3

✓better | same | ✗worse

| Distance | 0 - 10m | >10 - 20m | >20 - 40m | >40 - 60m | >60 - 80m | >80 - 100m |
|---|---|---|---|---|---|---|
| Per Round | 2.8 | 3.2 | 2.4 | 1.1 | 1.2 | 1.9 |
| Shots to Hole | 2.4 shots | 2.5 shots | 2.8 shots | 3.0 shots | 2.9 shots | 3.0 shots |
| Dispersion | 2.5m | 3.2m | 4.4m | 6.5m | 6.8m | 8.3m |

Round | Putting | Sand | Short Game | Long Game | Extra Long Game | Putts Tabular | Shots Tabular

| Statistic | Chart | Last Round ○ Benchmark | Last 5 Rounds ○ Benchmark | Last 10 Rounds ○ Benchmark | All Rounds ○ Benchmark |
|---|---|---|---|---|---|
| Score | | 78.0 (+1.0) | 77.0 (+5.0) | 78.2 (+6.2) | 77.0 (+6.2) |
| Putts | | 30.0 | 32.6 | 32.5 | 32.6 |
| Penalties | | 0.0 | 1.2 | 1.0 | 0.9 |
| Greens in Regulation (GIR) | | 10.0 (56%) | 10.8 (60%) | 9.7 (54%) | 10.5 (58%) |
| Up and Downs | | 6.0 / 15.0 (40%) | 3.2 / 12.2 (26%) | 3.7 / 12.6 (29%) | 4.0 / 11.8 (34%) |
| Scrambles | | 5.0 / 8.0 (63%) | 2.0 / 7.2 (28%) | 2.1 / 8.3 (25%) | 2.5 / 7.5 (34%) |
| Chip-ins | | 0.0 | 0.0 | 0.0 | 0.0 |
| Sand Saves | | 0.0 / 1.0 (0%) | 0.2 / 1.4 (14%) | 0.5 / 2.1 (24%) | 0.3 / 0.9 (31%) |
| Putts per GIR | | 1.9 | 1.9 | 1.9 | 1.9 |
| Putts per non-GIR | | 1.4 | 1.7 | 1.6 | 1.6 |
| First Putt Length | | 17.7ft | 17.3ft | 16.4ft | 16.9ft |
| First Putt Length GIR | | 27.1ft | 21.2ft | 21.1ft | 21.0ft |
| First Putt Length non-GIR | | 6.3ft | 11.8ft | 11.1ft | 11.2ft |
| Holed Putt Length | | 2.5ft | 3.5ft | 2.6ft | 3.3ft |
| Drive Length (Avg.) | | 239.9m | 246.2m | 247.5m | 243.6m |
| Drive Length (Longest 2) | | 300.5m | 296.9m | 299.3m | 298.1m |
| Drive Fairways Hit | | 11.0 / 14.0 (79%) | 10.0 / 14.0 (71%) | 9.4 / 14.0 (67%) | 3.2 / 13.9 (23%) |
| Wasted Shots | | 0.0 | 1.4 | 2.4 | 1.3 |
| Wasted Shots From Drives | | 0.0 | 0.8 | 1.6 | 0.9 |
| Eag \| Bir \| Par \| Bo \| Others | | 0.0 \| 2.0 \| 13.0 \| 3.0 \| 0.0 | 0.0 \| 1.8 \| 10.8 \| 4.4 \| 1.0 | 0.0 \| 1.3 \| 10.0 \| 6.1 \| 0.6 | 0.0 \| 1.9 \| 10.1 \| 5.1 \| 0.9 |
| First 6 \| Middle 6 \| Last 6 | | +1.0 \| 0.0 \| 0.0 | +2.0 \| +1.2 \| +1.8 | +2.4 \| +1.8 \| +2.0 | +1.9 \| +1.6 \| +1.6 |
| Score Par 3 \| Par 4 \| Par 5 | | 3.3 \| 4.0 \| 5.0 | 3.3 \| 4.4 \| 5.1 | 3.6 \| 4.3 \| 5.3 | 3.3 \| 4.3 \| 5.1 |

Refresh

Figure 17

| Hole | 1 | 2 | 3 | 4 | 5 | 6 | 7 | 8 | 9 | Out |
|---|---|---|---|---|---|---|---|---|---|---|
| Metres | 366 | 301 | 469 | 296 | 454 | 157 | 328 | 163 | 386 | 2920 |
| Index | 5 | 15 | 11 | 17 | 9 | 3 | 13 | 7 | 1 | |
| Par | 4 | 4 | 5 | 4 | 5 | 3 | 4 | 3 | 4 | 36 |
| Score | 4 | 4 | 4 | 4 | 5 | 3 | 5 | 3 | 4 | 36 |
| To Par | E | E | -1 | -1 | -1 | -1 | E | E | E | |

| Hole | 10* | 11 | 12 | 13 | 14 | 15 | 16 | 17 | 18 | Total |
|---|---|---|---|---|---|---|---|---|---|---|
| Metres | 478 | 130 | 428 | 374 | 335 | 352 | 133 | 305 | 396 | 5851 |
| Index | 8 | 16 | 18 | 6 | 10 | 2 | 14 | 12 | 4 | |
| Par | 5 | 3 | 5 | 4 | 4 | 4 | 3 | 4 | 4 | 72 |
| Score | 5 | 3 | 4 | 5 | 3 | 5 | 4 | 4 | 3 | 72 |
| To Par | E* | E | -1 | E | -1 | E | +1 | +1 | E | E |

PREDICTIVE GOLF AID

CROSS REFERENCE TO RELATED APPLICATION

This application claims the benefit of U.S. patent application Ser. No. 13/504,983, filed Apr. 30, 2012 which is a U.S. National Phase Application of PCT/AU2010/001451 filed Oct. 29, 2010, as amended under PCT Article 19 by Amendment dated Feb. 28, 2011, which claims priority to Australian patent application 2009905324 filed Oct. 30, 2009.

FIELD OF THE INVENTION

This invention relates to a golf improvement aid and in particular to an aid that can be used in the coaching of golf, or for use by a golf player to improve their game.

BACKGROUND TO THE INVENTION

Golfers often do not know, or have an understanding of how or where to most effectively spend their training efforts for the best effect on their score. Coaches might not necessarily have this information either or can only deduce subjectively if they take the opportunity to closely observe the player in action. This is often not transferrable information and far too time consuming for coaches when they have a number of golfers to train.

There are many golf statistics programs on the market, many of these are quite recreational in nature and therefore they provide novelty interest but are not easy to use or as specifically targeted toward structured and planned golf improvement with useful player/coach interaction.

Accordingly, it is an object of the present invention to overcome or at least ameliorate one or more of the disadvantages of the prior art.

SUMMARY OF THE INVENTION

In accordance with the invention there is provided a golf improvement aid having at least one input for receiving inputted data of a real game of golf of a user, a collator for receiving and automatically collating the input from the input means on one or more holes in the game of golf; a determinator for determining a model for the particular user based on the collated input for a plurality of holes in one or more games of golf of the user; and "one or more outputs for outputting results or information based on results from the determined model.

The golf improvement aid can include a further what-if input means for allowing input of a variable of the input such that the model provides a hypothetical result based on the variable input in the determined model for that user.

The golf improvement aid can include a further comparative input means for inputting an input of one or more comparative users or benchmarks such that the model provides a comparative result based on the comparative input in the determined model for that user.

The golf improvement aid can include an output means for outputting a suggested training routine or improvement that has been determined by an improvement analyzer from anyone or more of the first, second, third or fourth output.

In accordance with the invention there is also provided a means of collating input from a user to define a model of play of the user whereby the model is based on determination of number of shots to the hole in a game of golf.

The user specific model can include review of categories of distance of shots undertaken by the user in a game of golf.

The categories can include ranges of distances of shots. The ranges can be general categories based on the likely dispersion of the shots due to the user's ability. This can include predetermined due to skill of player such as ranges of 20 meters with dispersion variations of less than 10 meters for a highly skilled player. At the other end of the scale the ranges could merely be long shots medium shots short shots and putts for casual players.

The dispersion of a shot from the planned shot could also be a factor that is separately inputted or separately automatically determined by comparison of the previous inputted distance to hole to the next inputted distance to hole.

The player can input expected distance to selected aiming position for a golf shot in the game of golf and distance of resultant golf shot in the game of golf from the selected aimed position.

Also in one form of the invention there is provided a golf improvement aid comprising:

- a first input means for receiving input of one or more of:
  - distance of user from present position to hole in a game of golf;
  - distance to selected aiming position for a golf shot in the 'game of golf;
  - distance of resultant golf shot in the game of golf from the selected aimed position;
  - distance of resultant golf shot in the game of golf from the hole
- a collator for receiving and automatically collating the input from the input means on a plurality of holes in the game of golf;
- a first output means for outputting the collated inputs; a determinator for determining a model for the particular user based on the collated input for a plurality of shots in one or more games of golf of the user;
- a secondary what-if input means for allowing input of a variable of the input such that the model provides a hypothetical result based on the variable input in the determined model for that user;
- a second output means for outputting the hypothetical what-if result;
- a tertiary comparative input means for inputting an input of one or more comparative users or benchmarks such that the model provides a comparative result based on the comparative input in the determined model for that user;
- a third output means for outputting comparative result a fourth output means for outputting a suggested training routine or improvement that has been determined by an improvement analyzer from any one or more of the first, second, third or fourth output.

The invention can be provided in a carryable personal digital apparatus.

The invention can be provided in a software package.

The invention also provides a website (web application) version of the golfing aid which is a service based tool for golfers and their coaches to help identify the areas of a player's game that have the most effect on their performance and therefore allow them to focus their training efforts in the most effective way. It also provides a platform for coaches to monitor and interact with their players and provide a better coaching service.

Some of the features of the golfing aid can include:

(a) Simple Round/Shot Entry

The user is required to enter the distance from the hole before each shot. From such 35 input data, a player can deduce important performance related information. Such information can include the type of golf club to be used, the speed and angle at which the golf club is to be swung etc. However a secondary entry can be the distance to a predetermined shot aiming location.

(b) Collator

The information inputted is effectively collated into predetermined categories and a predetermined statistical variance. The statistics can be used in raw form at this stage but fundamentally is fed into the determinator.

(c) Determinator

The collated information is used by the determinator to formulate a model which is representative of the individual. A model is deduced from the players own shot data, so it is specific to that player's game.

(d) What-If Analysis Tool

Allows a user to predict their score based on hypothetical adjustments in either the shot dispersion or the number of shots it takes to hole out from a given distance range. Therefore the expected result is determined by the individual model on the player's variation of input.

(e) Comparison Analysis

Further variations can be inputted into the individual model to see the expected result. In this way the result of a similar player could be input and compared to the user's individual model to identify the weakness of the' player compared to others at similar level.

(f) Coach/Player Relationship

The application allows a coach to have an online coaching relationship with one or more players. The coach then has the ability to review/monitor one of their players. A coach can also store notes about a player. Also can have the ability for a coach to communicate with their players online. A coach can also group their players into squads for comparison/benchmarking and communication purposes.

(g) Benchmark Comparisons

Uses can view their performance data and compare with a number of different benchmarks. For a player this can be based on cause factors, their own playing data, or collective data from other players (such as handicap range, score range or player category). Coaches, however, can compare with individual players or groups of players they have a coach-player relationship.

(h) Rankings

Coaches can rank their players or squads across many performance metrics.

(i) Training

Players can enter and track their training performance. This can be linked to goal setting and analysis information.

(j) Sensitivity

Players can highlight the areas of their game that are most sensitive to their score using the "sensitivity" option. The sensitivity is derived as the frequency of occurrence of the distance range multiplied by the rate of change of the shots to hole versus distance.

The features of the golf improvement aid including the Simple Round/Shot Entry and the What-if Analysis Tool provide a unique novel golfing aid. This is based around shot information gathered from entry of a round of golf. Analysis information is collated and determined by being calculated or generated after round entry and stored in the database for fast recall when required by analysis tools, such as the What-if Analysis Model, charts and tabular statistics.

From this information the system deduces important performance related information. A first is deduction of statistical data from recording the distance to the hole for each shot such as:

Shots to Hole per Shot Distance Range,
Dispersion per Shot Distance Range,
Score,
Greens in Regulation,
Up and Downs,
Putts,
Putts per Green in Regulation,
Putts per Non-Green in Regulation,
First Putt Length,
First Putt Length per Green in Regulation,
First Putt Length per Non-Green in Regulation,
Holed Putt Length,
Drive Length.

A second is a comparative statistical data compared to other holes, other rounds, other players, and other clubs being used.

A third is the identification of improvement points that would most readily improve the final score of a game of golf.

A fourth is a set of training aims or practice regimes that would achieve the identified improvement points.

It can be seen that the invention provides improvements and advantages over the current products or methods by the use of simple data entry. With this minimalist data the system provides analysis tools that pinpoint the areas of a player's game that have the greatest effect on score.

The likely users are Golf Professionals—coaches and players, Elite Amateur Golfers and any golfer with aspirational goals, or an interest in analyzing their golf performance.

BRIEF DESCRIPTION OF THE DRAWINGS

In order that the invention can be more readily understood an embodiment will be described by way of non-limiting example with reference to the drawings wherein:

FIG. 17 provides an output by the collator in the form of statistical analysis in accordance with one embodiment of the invention.

DESCRIPTION OF A PREFERRED EMBODIMENT OF THE INVENTION

Figure 2:
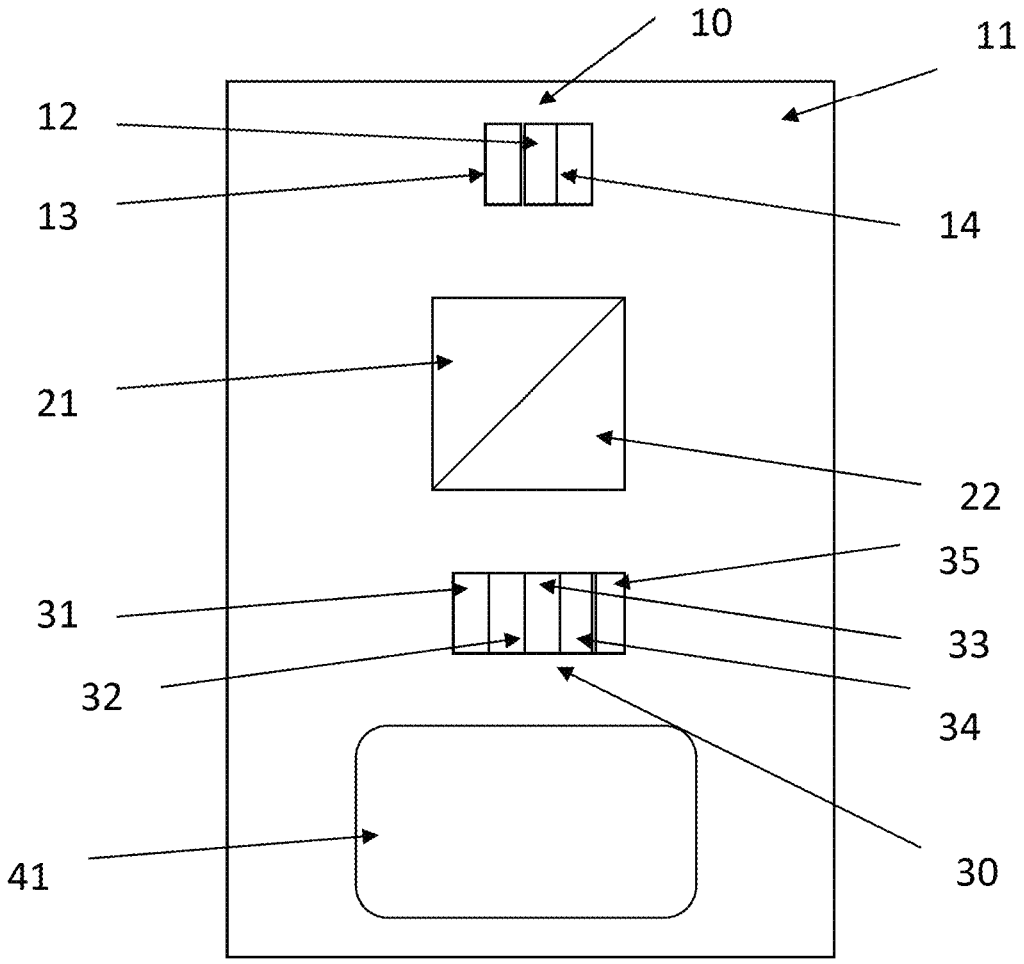
FIG. 2 is a diagrammatic view of a golf improvement aid according to an embodiment of the invention.

In this preferred embodiment as shown in one form in FIG. 2, the invention provides a golf improvement aid 11 having a plurality of inputs, a golf improvement aid having at least one input for, receiving inputted data of a real game of golf of a user, a collator 21 for 'receiving and automatically collating the input from the input means on a plurality of holes in the game of golf; a determinator for determining a model for the particular user based ali the collated input for a plurality of holes in one or more games of golf of the user; and one or more outputs for outputting results or information based on results from the determined model.

The golf improvement aid 11 can be a handheld device or a carryable personal digital apparatus with software. The golf improvement aid 11 can further be provided in a software package to be downloaded and used on a number of devices. The invention can also be, or used in combination with, a web application.

In particular the golf improvement aid 11 can include a plurality of input means 10. A first input means 12 for receiving input of the golf shots of the user. This can be in a number of forms including a) distance of user from present position to hole in a game of golf; b) distance to selected aiming position for a golf shot in the game of golf; c) distance of resultant golf shot in the game of golf from the selected aimed position; and d) distance of resultant golf shot in the game of golf from the hole.

The first of the three inputs is illustrated in FIG. 1. In this embodiment of the invention, the first input means 12 is displayed with the following features: the shot or putt number taken by the user; and data entry point 16 to allow the user to input data in the form of the distance of the ball from the hole. The shot number can be predetermined or fixed by the golf improvement aid or manually inputted by the user. Where the shot number is predetermined, the predetermined values can be generated from the comparative input means 14 and, given such cause factors as the experience of the user or skill level, indicate the number of shots the user should be able to put the ball in the hole.

Figure 1A:
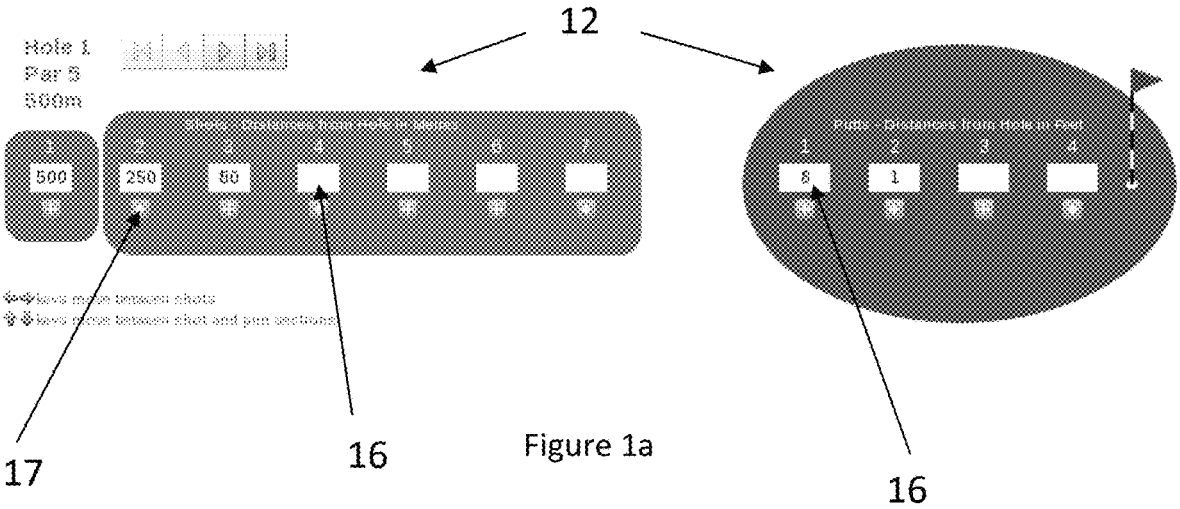
FIG. 1*a* is a diagrammatic view of an input to a golf improvement aid according to an embodiment of the invention.

In the form of the invention presented in FIG. 1*a*, the shot number is listed as 1 to 7 and has been predetermined by the golf improvement aid based on the comparative 30 input means 14. At the first shot taken, the ball is 500 meters from the hole. The user, in 3 shots, has moved the ball 80 m from the hole. Further. to this form presented in FIG. 1*a*, the improvement development aid provides for an input of data relating to the putts taken by the user.

It is envisaged that the shots and putts can be recorded on the same diagram however, in the above preferred embodiment, as the technique and skill required in taking a shot in contrast to a putt is 'different, the separation allows the user or a coach of the user to better identify the strengths and weaknesses of the user.

The first input means 12 allows input of the distance in meters the ball is from the hole. This distance can be provided for in different measurement units or different measurements units in contrast to putts in which either can be based on the user preference or predetermined units by the apparatus based on cause factors. The measurements can be in metric or non-metric units.

For example, the user can select putts in feet and enter their shot details in the data entry point 16 in feet. The input data is collated by the collator 21, processed by the determinator 22 and converted according to the International System of Units ("SI. Units"). The output means 30, calculated on the SI units, can be presented or displayed to the user in feet or as desired.

The embodiment in FIG. 1 a illustrates the minimum input data required by a user. The invention can be varied to allow a user to provide different degrees of information into the data entry point 16. Such variations can be provided for, in one form, as data expansion 17 to allow the user the option of entering such additional data.

Such data assists in identifying performance related information which can then be used by the user or coach to identify their weaknesses or strengths. Such information can include the type of golf club to be used, the speed and angle at which the golf club is to be swung etc. However a secondary entry can be the distance to a predetermined shot aiming location.

Figure 1B:
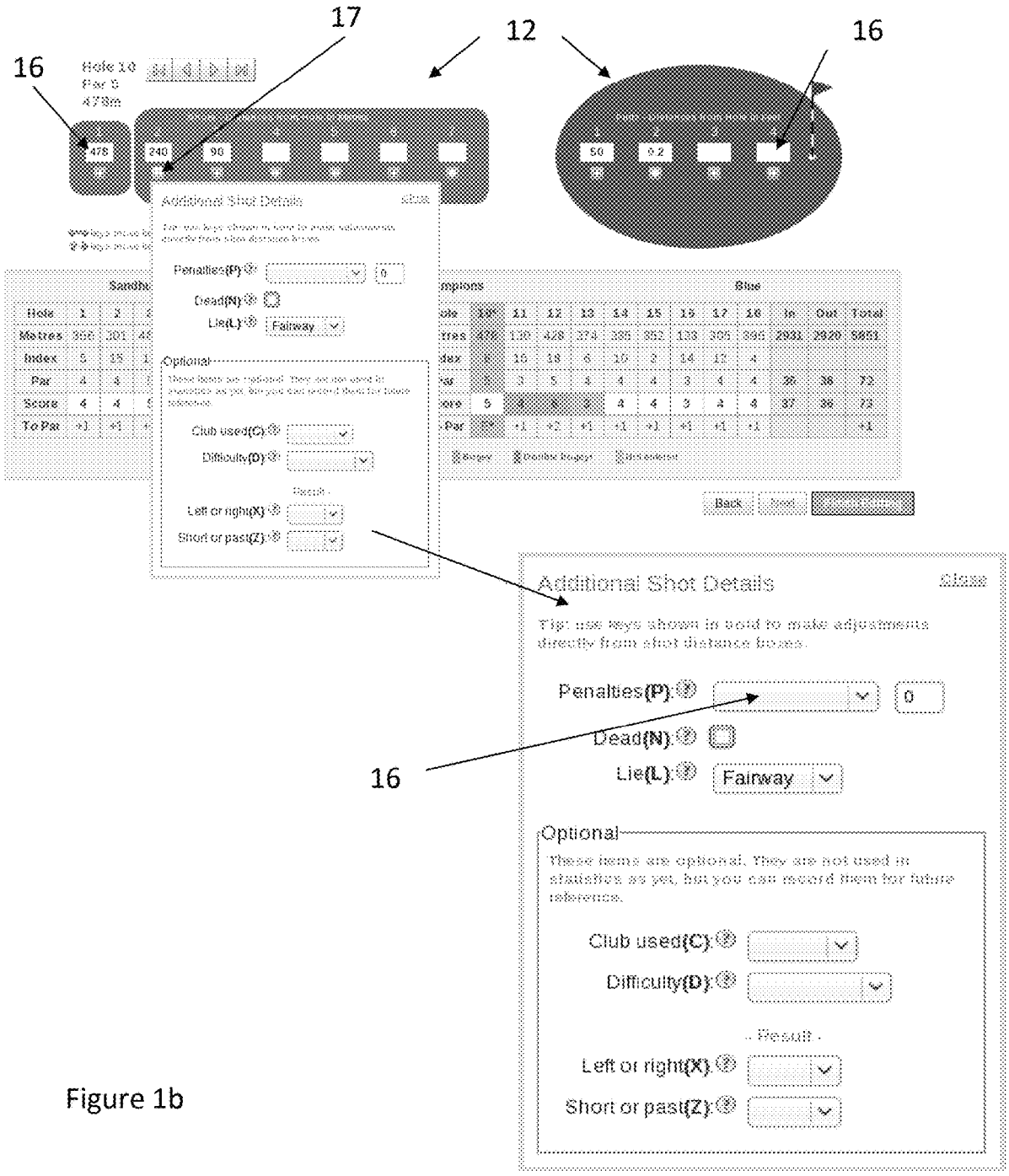
FIG. 1*b* is a diagrammatic view of an input to a golf improvement aid' according to an embodiment of the invention.

Therefore, further input data for the first input means 12 can be provided by the User as illustrated in FIG. 1*b* such as the penalties incurred from carrying out a particular shot, the difficulty of the shot, the result position of the shot, i.e. whether it went left or right to the hole or short or past the hole, whether the ball is 'dead' meaning that the ball cannot be advanced to the desired target because of its location and/or lie and club used and the like. The user can also enter a 'note' or details regarding the shot or putt taken or to write something of interest about a particular shot.

A further of the three inputs can be a secondary 13 what-if input means for allowing input of a variable of the input such that the model provides a hypothetical result based on the variable input in the determined model for that user. In one example, the what-if input can assist in identifying the resultant effect if the speed or angle of the golf club had been varied to a certain degree.

Figure 6:
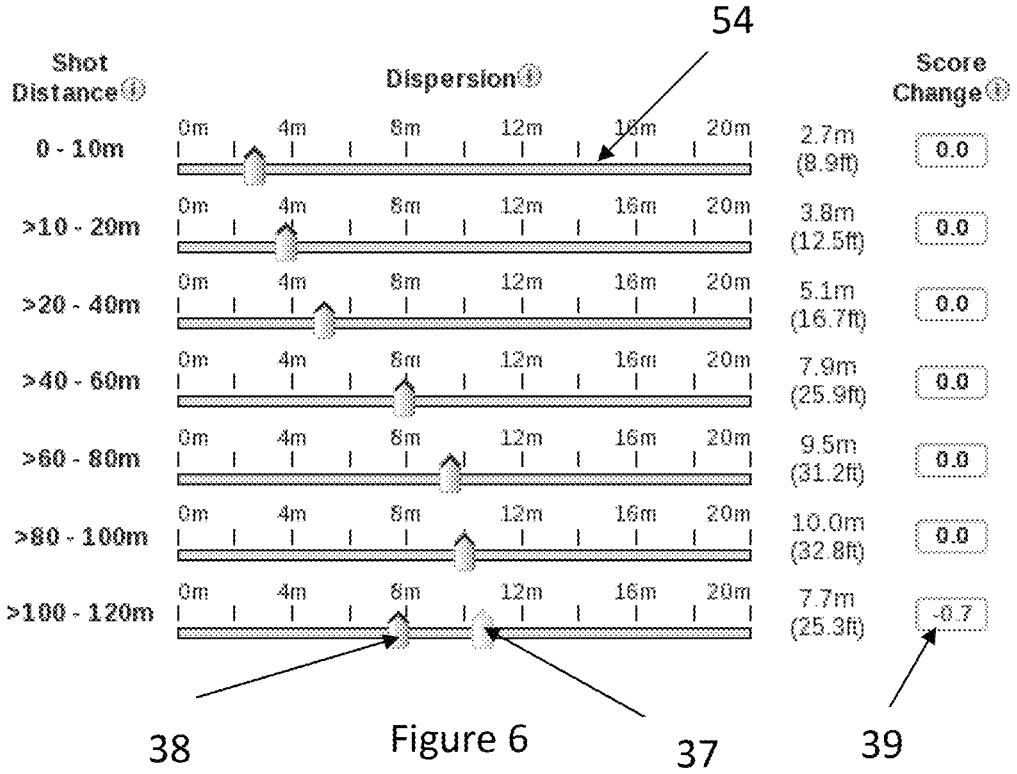
FIG. 6 is an output of the what-if input model for a user of a golf improvement aid according to an embodiment of the invention.

An embodiment of the secondary 13 what-if input means is illustrated in FIG. 6. The secondary 13 what-if input means is inputted into the golf improvement aid by, in one form, the movement and sliding of a tab member 38. The tab member 38 can be moved from the position of an actual real game result (the first position) to a hypothetical result (the second position) along a dispersion scale 54 and upon movement of the tab member 38 from its first position reveals an indication function 37.

Figure 4:
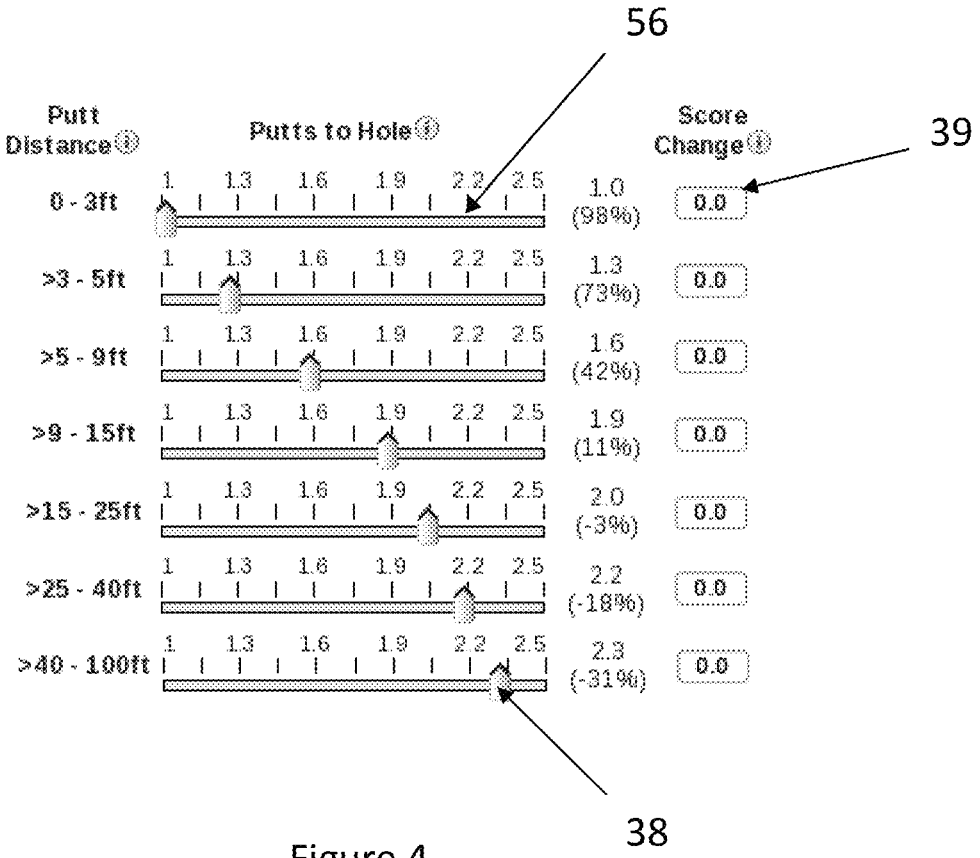
FIG. 4 is a what-if input model for the number of putts to hole for a user of a golf improvement aid according to an embodiment of the invention.

The dispersion scale 54 provides for the average distance from the hole after playing a shot from the distance range and can be predetermined by the golfing improvement aid or can be set according to a user's skill or cause factors. Linear interpolation of the shots to hole value can be used to provide a smoother and more accurate prediction of the shots to hole value when between distances ranges.

Where the shot taken is a putt, as in FIG. 4, the number of putts to hole scale 56 is used instead of the dispersion scale 54. Further, FIG. 4 illustrates the percentage of obtaining the number of putts to hole and a negative appears where more than 2 putts are taken, with 2 putts being the international standard.

In the example presented in FIG. 6, the sliding movement of the tab member 38 to a desired location on th!3 dispersion scale 54 provides for a hypothetical result in the form of the secondary 13 what-if input means. Therefore, the user in FIG. 6 has provided what-if input data of 7.7 m at a shot distance of between 100 to 120 m.

A further feature of the secondary 13 what-if input means is that a user can enter a suggested improvement. For example, a user can enter in as input data their desire to, where the ball is 3 m from the hole, have the" ball in the hole by two putts and the determinator will update the model accordingly to assist the user in identifying how their game is to be improved to reach this goal.

Figure 3:
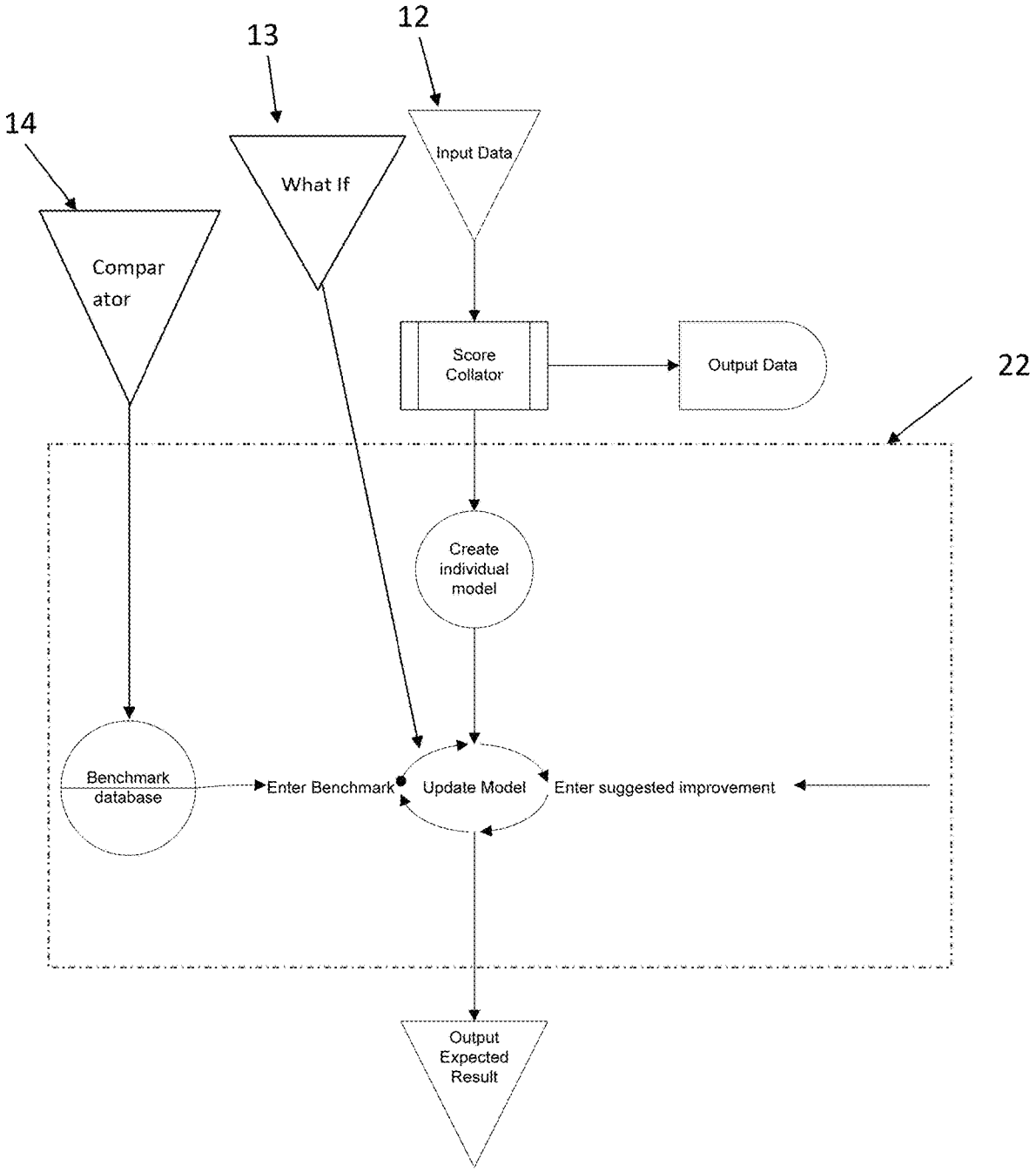
FIG. 3 is a flow diagram of a method for forming and using a model for a player in a golf improvement aid according to an embodiment of the invention.

A third of the inputs can be a comparative input means 14 for inputting an input of one or more comparative users or benchmarks such that the model provides a comparative result based on the comparative input in the determined model for that user. Such a comparative input can be stored into a database for access as desired and the comparative input can be categorized according to the cause factors. This database is identified in FIG. 3 as the benchmark database. The aim of the third input is to allow for the individual user or coach to identify the level of improvement in the user comparison to others of the same level of skill.

The comparative input means 14 can be inputted by a coach to assess one student against another. Alternatively, the golf improvement aid allows each user/student to enter their own individual data and a coach can access each user's account as authorized. The comparative input means 14 can further provide input data from a golf icon or professional golfer which the user can allow themselves to be compared to. Further the comparative input means 14 can include data of others within the same or similar range of cause factors. For example, of the similar age, skill level, experience, tournaments won and practice hours.

The golf improvement aid 11 further includes a collator 21 for receiving and automatically collating the input from the input means on a plurality of holes in the game of golf and a determinator 22 for determining an individual model 29 for the particular user based on the collated input for a plurality of holes in one or more games of golf of the user.

The collator 21 and determinator 22 provide for a plurality of output means 30. The plurality of output means 30 is displayed to the user according to the individual model 29 created by the determinator. Such an individual model can be a benchmark model, a per round model or a sensitivity model. The determinator then selects and manipulates the output means 30 according to each of the individual models.

The collator 21 collates inputs which are determined, calculated and presented in the form of statistical data or accumulative values as illustrated in FIG. 17. The statistical data can be further categorized according to predetermined categories. For example, the first putt length, the number of penalties, the number of wasted shots, average drive length, longest drive and the number of times a shot is played per round from each distance range.

The output means 30 can be connected and illustrated on a display 41 of a golf improvement aid. In another embodiment, the output can be in the form an audible voice or computer print-out. Alternatively, the output can be transmitted to and displayed on an external telecommunication device or computer.

The outputs can have a first output means 31 for outputting the collated inputs; a second output means 32 for outputting the hypothetical what-if result; a third output means 33 for outputting comparative result; a fourth output 34 means which highlights the areas of a users game most sensitive to their score; and a fifth output means 35 for outputting a suggested training routine Of improvement that has been determined by an improvement analyzer from anyone or more of the first, second, third or fourth output.

Figure 8:
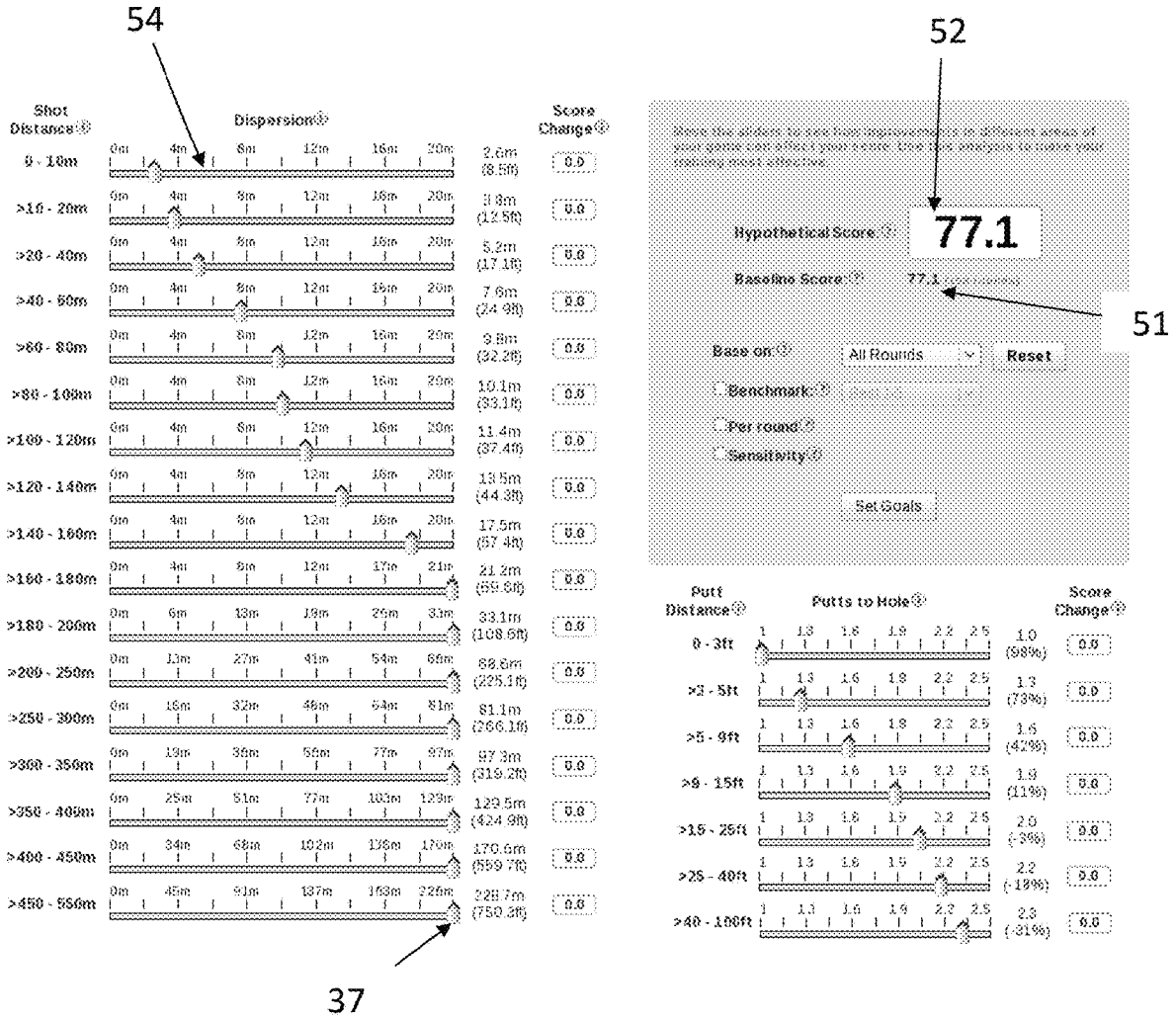
FIG. 8 is a detailed output of an amendable what-if model for a user in a golf improvement aid according to an embodiment of the invention.

The first output means 31 provides the baseline score 51, being the actual results or data obtained from at least one real game, which is received from the data entered in the data entry point 16 for the first input means 12 for at least one shot and collated by the collator 21 and displayed accordingly in FIG. 8. The actual result can be based on a single game or an average result based on a collection of different games.

In a preferred embodiment, the user selects the actual result to represent an average data of a large number of shots or games to provide a reliable model. The user can identify through the 'base on' function 28 how the results will be interpreted and displayed by the determinator 22. The user can therefore select the desired filter mechanism and select the nature of their preference as to what the actual result will be calculated from. Hence the user can select different filter mechanisms such as the 'all round'. In contrast though, as the user improves, this filter mechanism will be less reliable of the current skills level of. the user and so the filter mechanism can then be set for example to the last 10 rounds.

Other filter mechanisms can include, but are not limited to: last 5 rounds, best ⅓, handicap, worst 10%, best 10%, date range, selected rounds by the user and round type.

In another form of the invention the actual results can be presented as an indication function 37 on the dispersion scale 54 as seen in FIG. 6.

Figure 15:
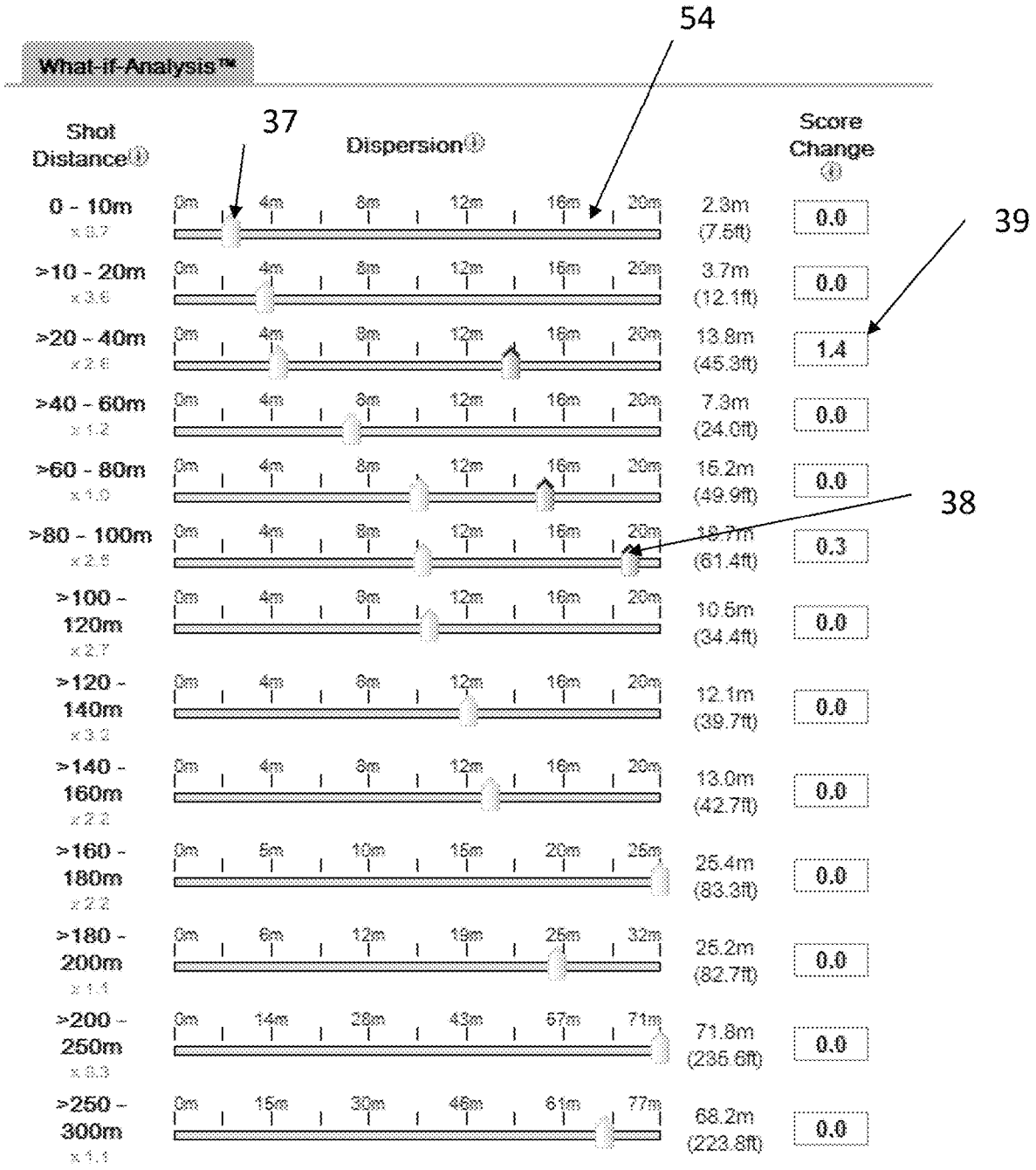
FIG. 15 provides a results output of the what-if analysis model and the 'per round' model to illustrate the number of times a shot is played (per round) from each distance range.

The first output means 31 can be further defined by the determinator 22 according to the 'per round' model. This is seen in FIG. 15 and is provided to indicate to the user or coach the number of times a shot is played (per round) from each distance range. For example, per round a shot distance between 0 to 10 m has been played 3.7 times.

The second output means 32 identifies the what-if result in accordance to the what-if model defined by the determinator 22. FIG. 6 illustrates that the user is able to have an indication function 37 to indicate the original value of the dispersion and the what-if result 38. The score change function 39 is determined by the determinator 22 to provide a calculated result identifying the change in score between the original value, being the value actually obtained by the user, and the what-if result, being a phantom result based on a hypothetical change of circumstances.

Figure 16:
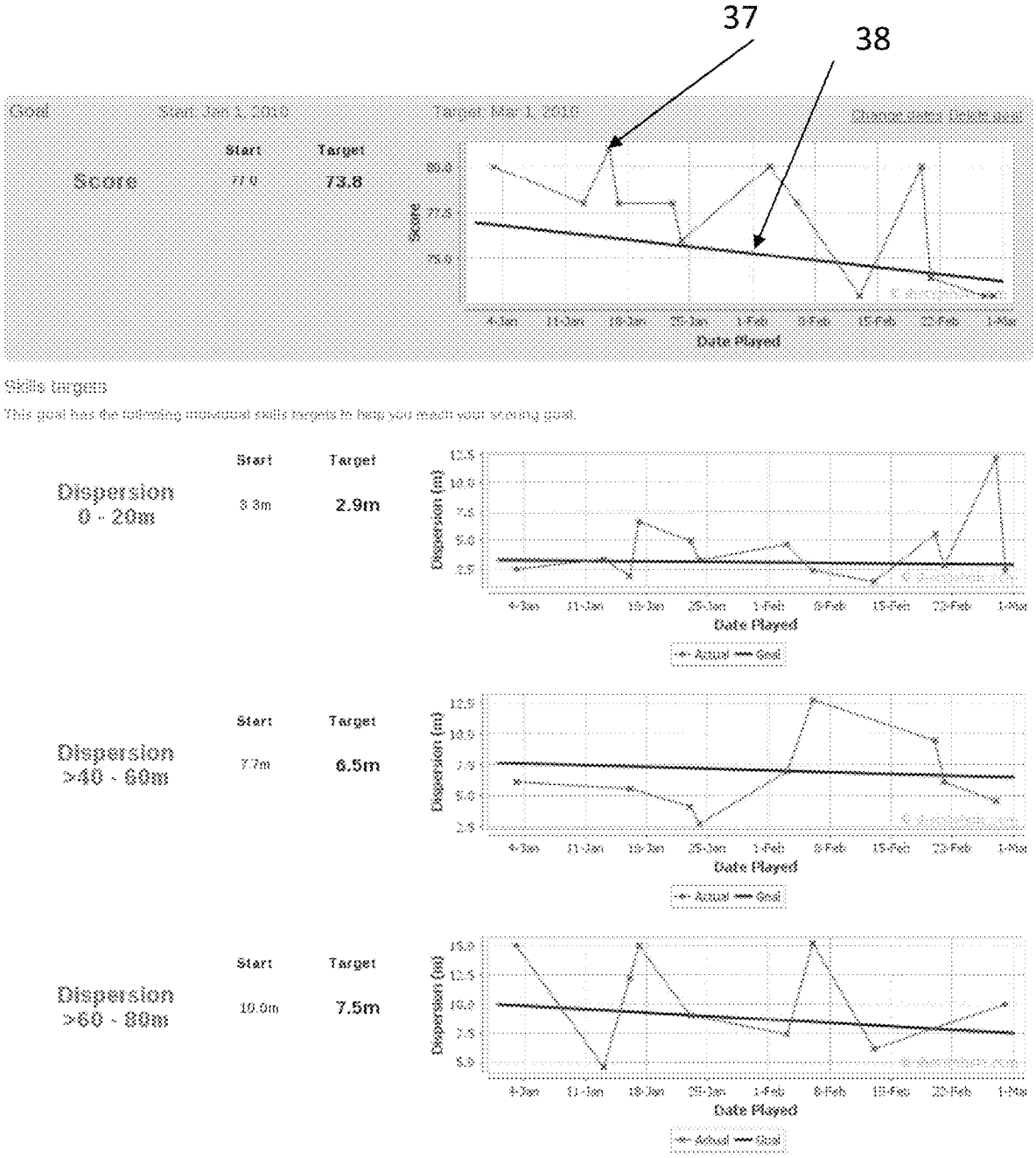
FIG. 16. provides a graphical representation of a player's actual score and skills targets over a predetermined period of time.

The hypothetical score 52, attained by the what-if input means 13, can be used and set by the user as a score goal or an associated set of skill targets or by the cause factors. The goal and skills targets can then be tracked over a set time period and displayed graphically. Examples are presented in FIG. 16. In addition to the hypothetical score, the adjusted dispersion and the shots to hole values can be translated into a score goal as well. This allows the user to set targets for different factors or areas of improvement.

By example, we refer to the user in FIG. 6 who was able to obtain the dispersion, being the average distance from the hole after playing a shot from the distance range, of 10.6 meters.

In one embodiment, a user can enter a hypothetical score as desired. Therefore, in FIG. 7, a user may wish to obtain a hypothetical score 52 of 70 instead of 76.0. In providing an input of such a hypothetical score, the golf improvement aid would, according to such models as the sensitivity model and relevant cause factors, provide an indication as to what areas of the user's game require improvement and the degree to improvement required.

Hypothetically, had the user in FIG. 6 been able to improve their skills so as to allow a dispersion of 7.7 m when taking a shot between 100 to 120 m from the hole, their game play would have improved to reduce their total score by 0.7.

Figure 7:
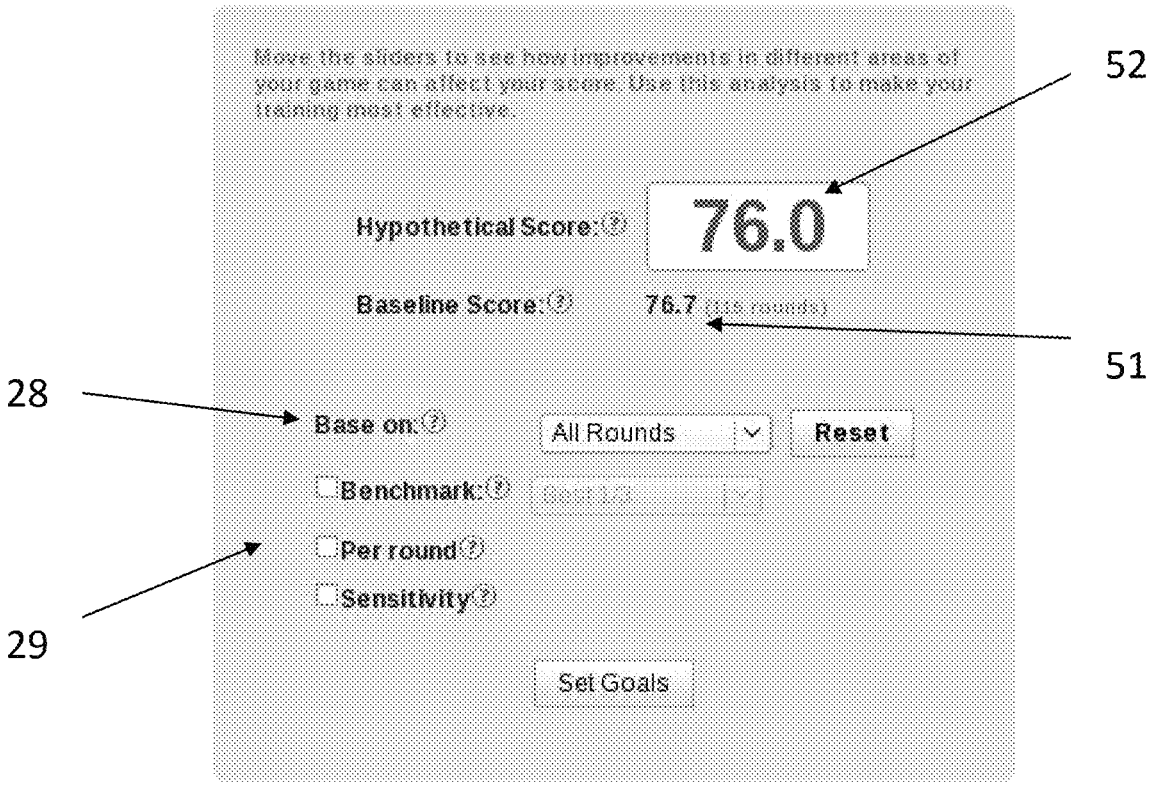
FIG. 7 is a results output of an amended what-if model for a user of a golf improvement aid according to an embodiment of the invention presented in FIG. 6.

This example can be further represented as illustrated in FIG. 7 where the hypothetical score 52 (referring to the score after making the adjustments), in comparison to the baseline score 51 (which is the users actual score prior to making adjustments) has improved by a reduction of 0.7. This reduction is the difference in the number of shots to hole, therefore the 0.7 reduces the putts to be taken.

In one form of the invention the reduction can be illustrated as a percentage value to assist a user in recognizing the degree of improvement required to achieve their goal target or benchmark value. Therefore, in the example where the user needs to improve their dispersion from 10.6 m to 7.7 m, it could instead be that the dispersion needs to be improved by 24%.

Further to such an embodiment, a 'further output can include predetermined values such as in percentage form to identify to a user a realistically attainable result. Alternatively, the predetermined data can be provided by the system according to cause factors such as age, skill level, experience, playing time, fitness, amount of practice time available. Therefore in viewing the ability to provide a first hypothetical score 52 as' a target or benchmark and a second score to provide a realistically attainable result to allow the user and the coach to set realistic goals. This can be provided as a tab like indicator to provide a warning where the user attempts to set a goal outside a reasonably attainable value.

Figure 13:
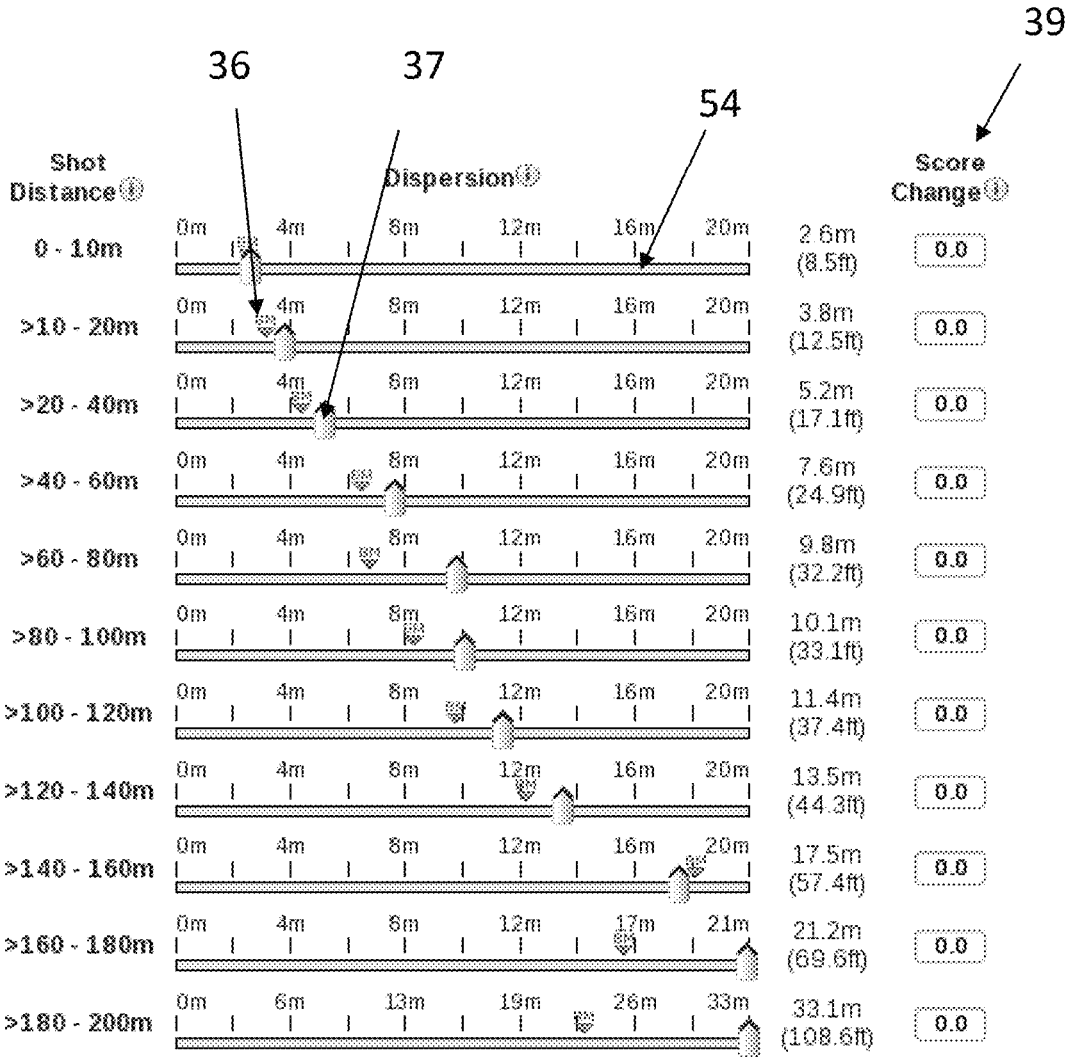
FIG. 13 is a results output of an amended what-if input of an output of a model for a payer and the output of a benchmark to provide a comparative result in accordance with an embodiment of the invention.

The third output means 33 provides the benchmark model as defined by the determinator 22. This allows the user's performance to be compared to a number of different benchmark factors such as the users own performance data in comparison to the inputted data of all users or users in a collective sense or the comparative golf inputs 14. The benchmark in FIG. 13 is identified by "BM" which is a collation of the comparative results which can be collated according to different cause factors.

The benchmark data can be obtained from a database with a filter based on cause factors in order to, for example, obtain the benchmark for individuals with the level of experience or years in practice corresponding to that of the actual user.

Figures 9, 10:
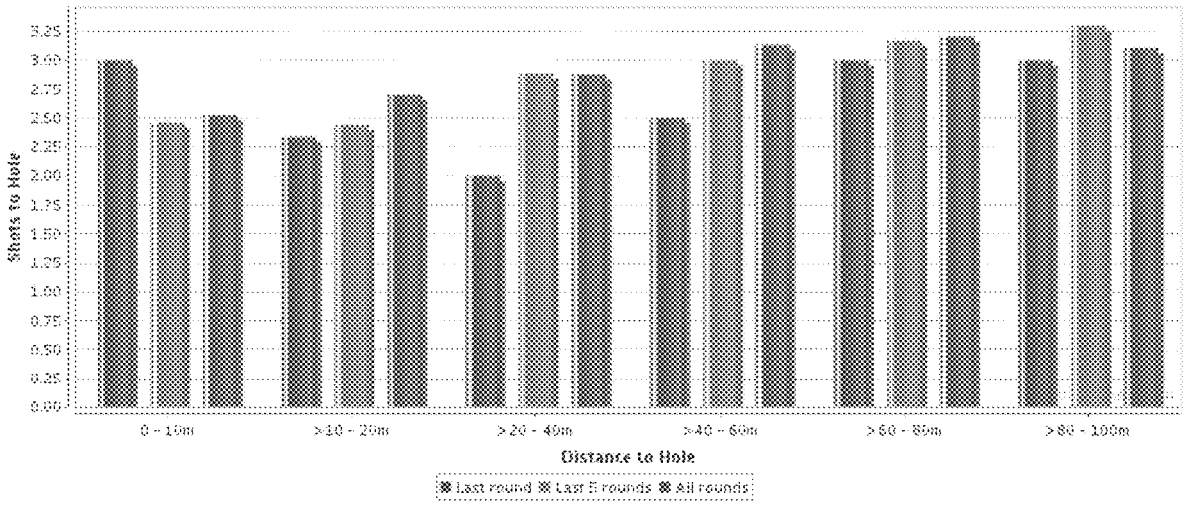
FIG. 9 is a shot analyzer output and comparator of a golf improvement aid 10 according to an embodiment of the invention.
FIG. 10 is a shots 0 to hole analyzer output and comparator of a golf improvement aid according to an embodiment of the invention.

Such a comparative analysis can also be conducted according to the user's own results and/or the benchmark 36. For example, in FIG. 9, the comparative analysis is between the user's current round and the last round played to then provide the assessment as to whether the user has performed better, worse or the same as their last round for example. Such a comparative analysis can be further displayed as a graphical representation as shown in FIG. 10.

Such a comparison can provide a comparative analysis on a plurality of filters, cause factors, games played. For example, FIG. 10 identifies a comparison between three such areas as the last round played by the user, in comparison to the last 5 rounds in further comparison to all rounds played.

Figure 11:
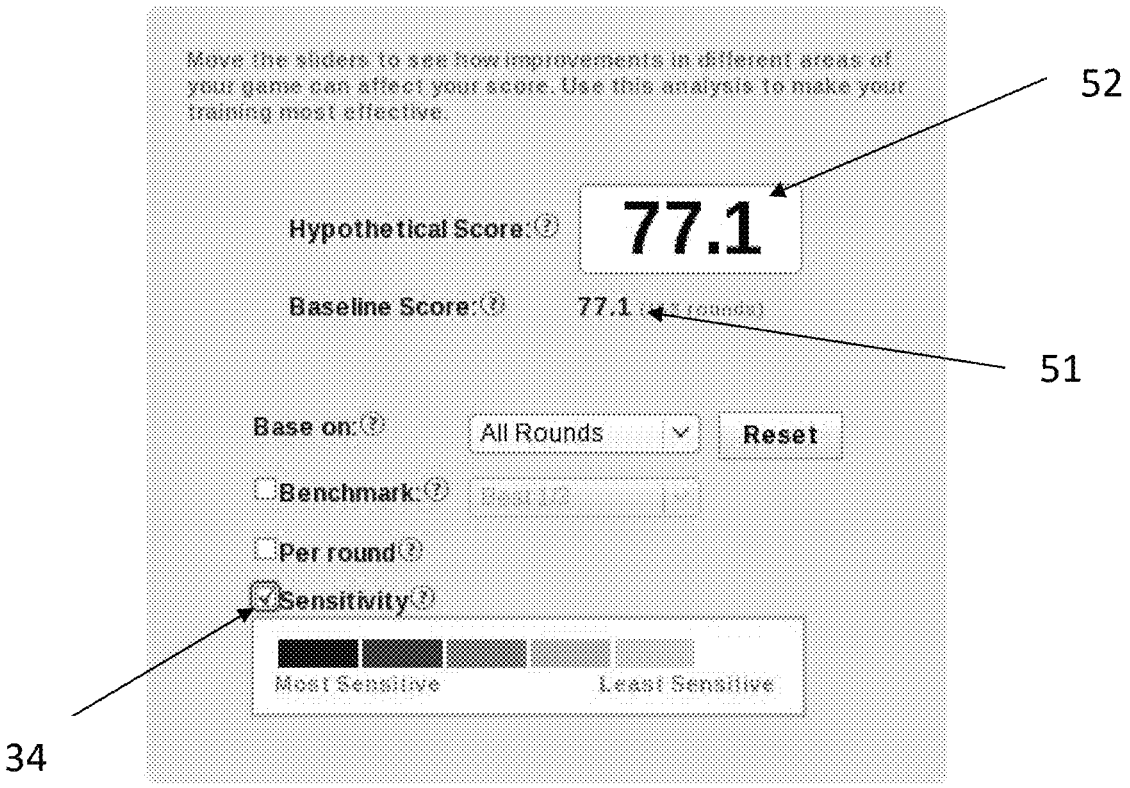
FIG. 11 is a results output of an amended sensitivity output for a player in accordance with one embodiment of the invention.
Figure 12:
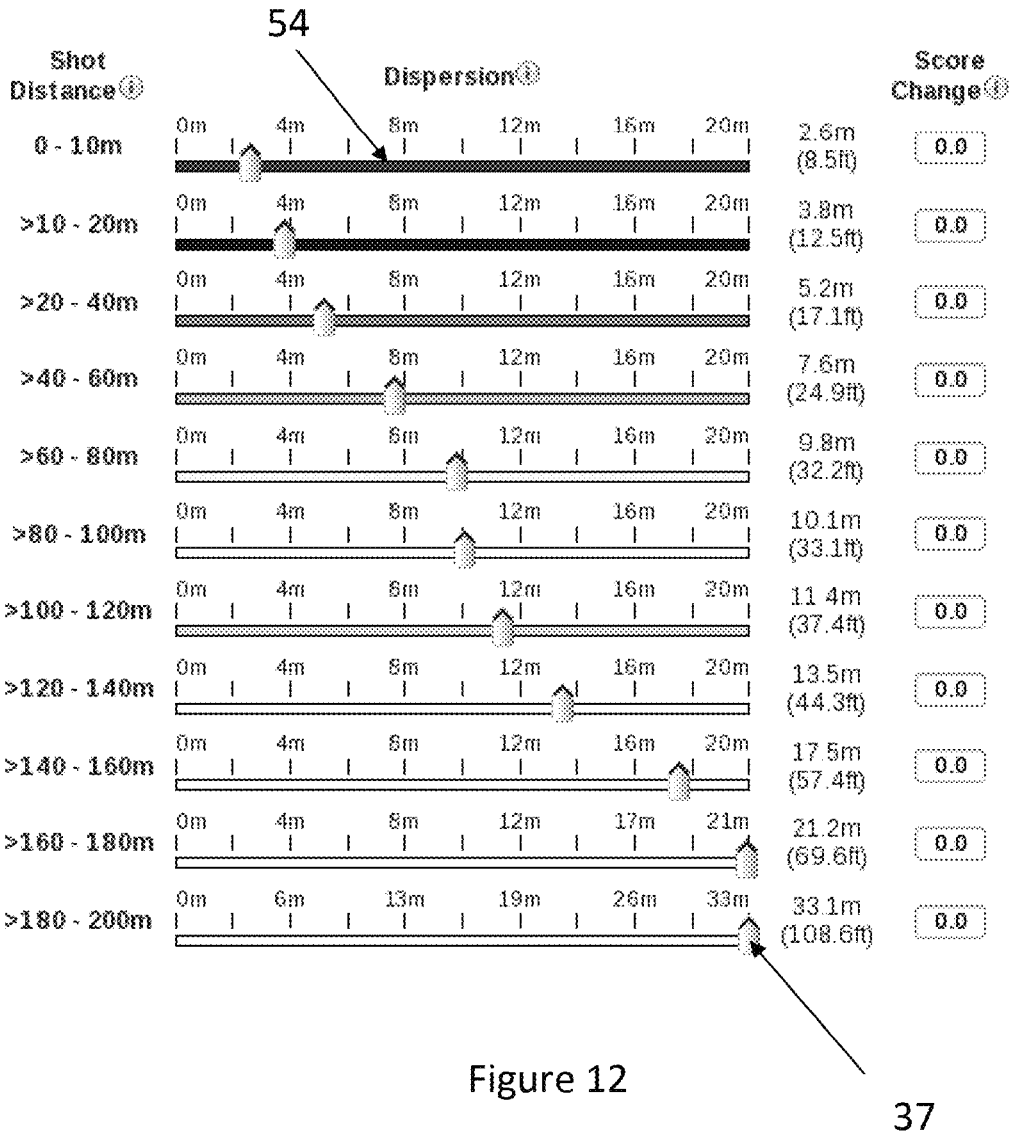
FIG. 12 is a sensitivity output for a player in the form of a color scheme illustrating the areas of a player's game which are sensitive to their score.

The fourth output 34 means is defined by the sensitivity model in accordance to the determinator 22 and identifies the areas of a user's game which are sensitive to their score. The sensitivity is derived as the frequency of occurrence of the distance range multiplied by the rate of change of the shots to hole versus distance. The sensitive areas in one form as presented in FIGS. 11 and 12 by color coding. Such a color code illustrates that the shorter distances present high sensitive areas and the longer distances to the hole provide for the least sensitive for this particular user. The concluding factor for the user in FIG. 12 is that as more of their shots are taken in the shorter distances and the shorter distances are most sensitive to their score, more practice is required during putting or shots in shorter distances from the hole to attain a higher score.

The fifth output means 35 provides a suggested training schedule in accordance to the collocation of the output means 30 identifying the strengths and weaknesses of the user. In particular, a training regime which assists the user in obtaining their targets or benchmark what if results, taking into such factors as the sensitivity of the users game play and current level of the user as identified by the baseline score 51.

Such training schedules can be predetermined and predefined by the golf improvement aid to generate fixed training schedules for different areas of weakness. Such training schedules can be filtered by such cause factors as time to practice to assist in generating an individualized and realistic training regime. Alternatively, the coach of a user can view the collection of the output means 30 of the user and define a personalized regime for the user to follow.

Further, the golf improvement aid provides the ability for the user to focus on a particular area of training. There, in one embodiment, a user is able to focus on a particular technique such as shot distances between 10 to 40 m. In doing so a user 35 can record this data in isolation as comparative input means 14 to identify how their game improves as a result of their practice session/so This is then displayed to the user to assist the user in recognizing how the practice session has assisted in enhancing their performance. This further provides a useful motivation technique and assists a user in recognizing the importance of learning different skills.

Once the output means has been presented the determinator can provide for a further level interrelationship between the different input means and output means described above. For example, in the embodiment presented in FIG. 13 the third output means 33 providing for a benchmark comparative result allows a user to align the secondary input means 13 with the third output means 33 such that the user can determine what their result would have been if they had reached the benchmark. In doing so, the user can set the hypothetical result, being the benchmark, as a goal or target.

Figure 14:
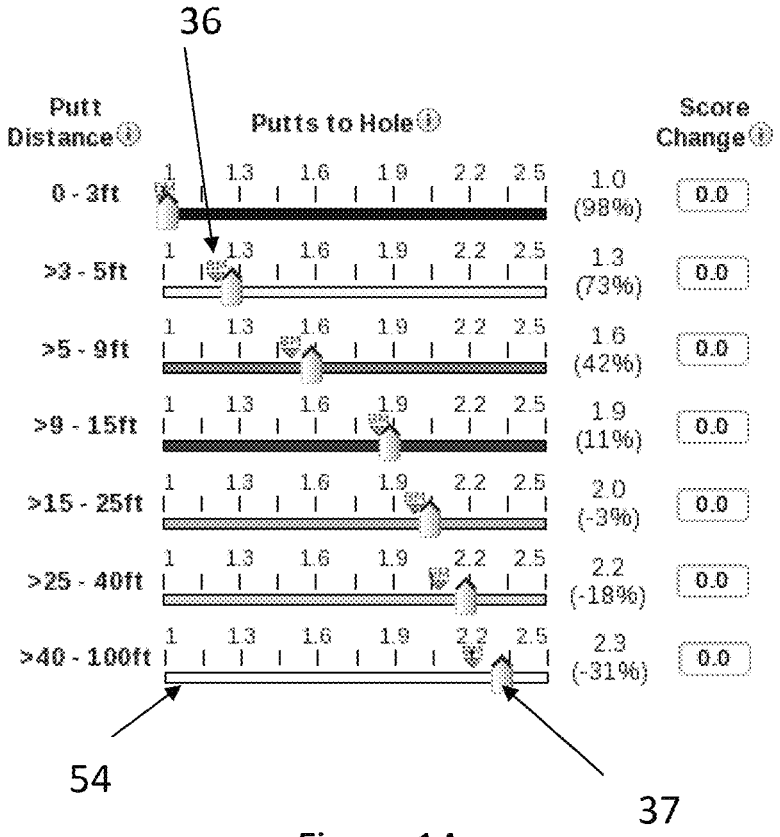
FIG. 14 provides a results output of the combined sensitivity model, the benchmark model and the what-if analysis model in accordance with an embodiment of the invention.

A further degree of analysis is provided in FIG. 14 where the golf improvement aid provides a single illustration of the output means 30 to allow a user to set their goals or what if secondary input means 13 in accordance to the sensitivity model and the third output means 33.

The following is an example of one embodiment of the invention where the hole distance is 500 meters. The user is to record the distance to the hole before playing 20 each shot. Such information is usually known or can be ascertained by the user, the coach or from signage or information cards provided by Golfing grounds.

Table 1 illustrates relevant information regarding the play of a user including the number of shots, corresponding to the distance travelled from the hole.

TABLE 1

Shot information recorded by user.

| Shot Number | Distance from Hole |
|---|---|
| 1 | 500 m |
| 2 | 250 m |
| 3 | 80 m |
| 4 | 8 m |
| 5 | 1 m |

FIG. 1 illustrates a diagrammatic view of an input to a golf improvement aid in the form of a shot entry panel in order to prompt the user for such information as the shot number and distance from hole. This screen aims to take the user's mind back to thinking about the golf hole and therefore making the recall of distances easier. However, users may wish to record the distance on paper during the round if they cannot recall the distances. The diagram is useful to trigger the user's memory of the golf hole, but user can always just jot down the distances on paper as they are playing the round. It does not need to be limited to paper, could be on a mobile phone, PDA, GPS device, score card, or a paper template designed for purpose. A mobile phone application could allow a user to enter the information while playing a round. If the mobile device is GPS enabled then the distance information could be obtained from the GPS information.

In such an embodiment, where a GPS system is used, the golf improvement aid allows the information from the GPS system to be automatically and directly translated into data on the golf improvement aid. This can be more convenient to the user in addition to ensuring more accurate input data. As a result, the user is not required to manually manual input of data into the data entry point 16.

The GPS distances or coordinates can be generated by relevant software, alternatively, simply by accessing a webpage the coordinates or distances from a target or hole can be obtained. Such a webpage can include the HTML5 and is convenient to the user as it does not require for the purchase or installation of additional software to access the GPS feature.

Figure 18:
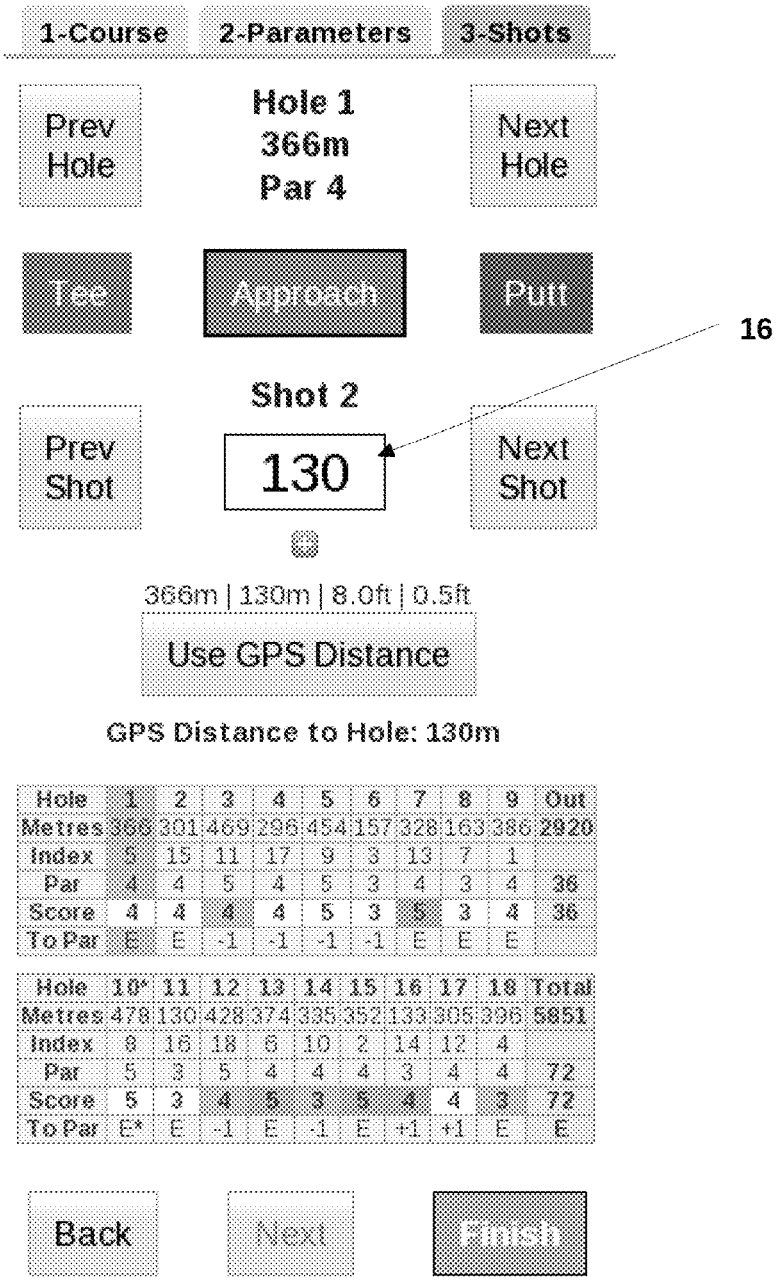
FIG. 18 provides an automatic mode of input from a GPS system in accordance with one embodiment of the invention.

Such an embodiment is presented in FIG. 18 where a user can generate this automatic input from a GPS enabled phone to the golf improvement aid by, for 25 example, holding down a "Use GPS Distance" function.

The golf improvement aid further provides for a system enhancement model whereby after a hole is completed, the system enhances the shot information with the Shots to Hole number and the Result Distance from Hole as illustrated in FIG. 1*a*. The Shots to Hole number is the number of shots it has taken the user to hole out from that shot distance counted back from the hole (and including the actual shot taken at that specific distance). The result distance is the Distance from Hole for the next shot. Table 2 is illustrative of the data system enhancement.

Table 2 illustrates shot information enhanced with number of shots to hole and result distance from hole.

| Shot Number | Distance from Hole | Shots to Hole | Result Distance from Hole |
|---|---|---|---|
| 1 | 500 m | 5 | 250 m |
| 2 | 250 m | 4 | 80 m |
| 3 | 80 m | 3 | 8 m |
| 4 | 8 m | 2 | 1 m |
| 5 | 1 m | 1 | 0 m |

Figure 5:
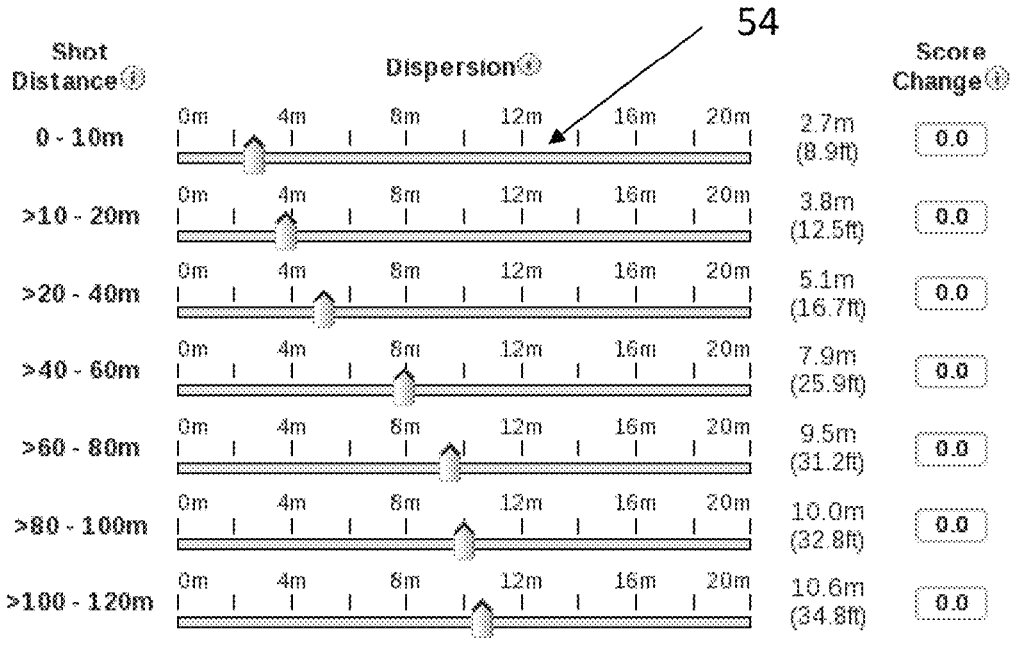
FIG. 5 is a results output of a model for a user of a golf improvement aid according to an embodiment of the invention.

FIG. 5 is an output of an analysis model. This analysis model is based on a collection of shots from rounds filtered in many ways. For example, all rounds, single round, rounds by course, rounds within score range and rounds within time frames. This is displayed as "Base on" in FIG. 7 which requires the user to select from a drop down list for selection.

Information regarding shots are grouped by distance range with Shots to Hole number and Result Distance from Hole averaged over shots for this distance range. The frequency of shots from this distance range is also applied to each distance range record, as seen in Table 3. Further, Table 3 represents Frequency as the number of times a shot is played from within the specific distance to the hole range during a round of golf. It is calculated as follows:

Frequency per Round=Number of shots taken from within the Distance to Hole range/Total number of rounds in the model (as per the filter).

TABLE 3

Shot information averaged over a distance range.

| Distance to Hole | Result Distance from Hole | Frequency per Round | Shots to Hole | Example Reference |
|---|---|---|---|---|
| 0-1 m | 0 m | 13.6 | 1 | |
| 1-2 m | 0.1 m | 3.9 | 1.4 | |
| 2-3 m | 0.2 m | 3.3 | 1.7 | |
| 3-5 m | 0.7 m | 6.8 | 2 | |
| 5-8 m | 1.2 m | 2.9 | 2.1 | [3] hypothetical result |
| 8-12 m | 2.1 m | 3.6 | 2.4 | [2] original result |
| 12-15 m | 2.9 m | 2.9 | 2.5 | |
| 15-20 m | 3.1 m | 6.5 | 2.6 | |
| 20-40 m | 5.1 m | 2.5 | 12.9 | |
| 40-60 m | 7.9 m | 1.3 | 3.2 | |
| 60-80 m | 9.5 m | 1.3 | 3.2 | |
| 80-100 m | 10 m | 1.9 | 3.1 | |
| 100-120 m | 10.6 m | 2.3 | 3.2 | [1] hitting from here |
| 120-140 m | 13.3 m | 3.4 | 3.2 | |
| 140-160 m | 17.1 m | 2.8 | 3.3 | |

Further to the system enhancement model, FIGS. 5 and 6 allows for an adjustment to be made to the Result Distance to Hole. This can be done' in one embodiment by sliding a button on the screen. Once an adjustment is made to the Result Distance to Hole, the system will then:

1. Look up the baseline result record having a Distance to Hole range matching the original Result Distance to Hole. This record provides the basis Shots to Hole number.
2. Look up the hypothetical result record having a Distance to Hole range matching the hypothetical Result Distance to Hole.
3. Calculate the change in score (or Delta Score) as the difference between the new Shots to Hole number and the original Shots to Hole number multiplied by the frequency of the distance range in question. Delta Score=(New Shots to Hole−Original Shots to Hole)× Frequency 4. Calculate the Hypothetical Score as the sum of the Baseline Score and the Delta Score as calculated in step 3. This is calculated by the following equate: Hypothetical Score=Baseline Score+Sum of (Delta Score for each distance 20 range)

An example calculation as shown in FIG. 5, assuming the user is adjusting the 100-120 m range from the above table:

Baseline Score=76.7

Frequency=2.3

5 Baseline Result Distance to Hole [11::: 10.6'"

Look up baseline result Shots to Hole (from 8-12 m putt range) [2]=2.4. If we adjust the Result Distance to Hole from 10.6 m to 7.7 m the calculation determined and shown as in FIG. 6 provides Look up result Shots to Hole (from 5-8 m putt range)[3]=2.1

Delta Score:::(2.1−2.4)×2.3=−0.69

Hypothetical Score=76:1+(−0.69)=76.0

It can be seen that we can test by distance from hole and determine this as being a dispersion factor. In this way the term dispersion describes the resulting distance from Hole. However we can also include actual dispersion which dispersion would be the result distance from the aimed shot target. Both overlap and dispersion is the same for short shots. However it may not be the case for a drive, or long fairway shot where the hole is not the target. Furthermore, there are many cases where a user is within range to target the hole, however, their strategic target is a different position than the hole.

Direct Shots to Hole Adjustment can be undertaken as the shot distance range gets closer to the hole then the dispersion is less effective or less important. For example, when putting from 10 ft, it is more useful to adjust the number of putts it takes to hole out (i.e. the Shots to Hole number). Therefore, we have the ability to adjust the Shots to Hole figure directly for putts.

In one version, the model assumes that the hole is always the target for the shot, however this is not always the case. Therefore in another embodiment of the invention, further inputs are made to track the shot result distance from the actual target rather than the hole (particularly on the green).

One of the main benefits of this concept is high value for minimum data entry. This sort of data capture would add to the burden of the user. However, in one embodiment GPS systems can be implemented in order to provide for an easier, effective and accurate record of measurements.

In a further embodiment of the invention when it is based online, the website (web application) provides a service based tool for golfers and their coaches to analyze a users performance and help identify the areas of a user's game that have the most effect on their performance and therefore allow them to focus their training efforts in the most effective way.

In such an embodiment, users sign up to use the service and purchase a subscription online, or from a distribution outlet where they will be given a subscription token to enter during sign up. There are various subscription levels for access to different features. Subscription° duration is variable, e.g. 3 month, 6 month, 12 month, etc. Both users and coaches can sign up for the service. A coach subscription includes the user subscription functions with a higher level subscription while having all features of a user they also have additional rights specific to coaches.

In use users enter their round information into the web application. Coaches have the ability to monitor and interact with their coached users as well as keep review notes about their users. There is a section for training that allows users to participate in training drills and track their performance. It is envisaged that coaches will prescribe particular training drills.

There are also various tools to view and analyze user performance. Both instantaneous and over time representations can be viewed and compared to 25 benchmarks. There is a model/tool to predict how a user's score will change based on improvements in areas of their game.

Stored user information will include user information stored during sign up.

Also entered can be information about each golf round, when and where played, weather, course conditions, personal conditions (emotional, fitness, etc). Further input is information about each golf shot played in a round of golf, such as distances from the hole (position of shot), result of shot, club used, difficulty, lie, and other pre and post conditions. After round entry is complete. the system generates additional analysis information about this particular round and its shots. This information is stored for future references and analysis. It also can provide training drill results derived from database on selected automatically dependent on the determine model of the user. Information can be included about the golf club/courses such as their name, address, phone number, web address and details of each golf hole, par, distance, index, etc. Finally coaches can keep coach review notes against their users.

User's content will be restricted in distribution. Clearly authority can be given to a coach. A user is either a coach or a user which can have .different data sharing capabilities as follows:

1. Coach: A coach can have a relationship with many users. A coach-user relationship is mutually agreed upon in an invite/accept approach. A coach can view any of their user's round, shot, conditions and analysis information on a read-only basis. The coach can use one or more of their users as a benchmark for comparison with another user or group of users that they have a coach-user relationship with. They can also perform rankings (across one or more performance measures) among their coached users.
2. User: A user can compare/benchmark themselves against other users in a collective sense only. e.g. handicap range, score range or user category. However, a user is not able to compare themselves to, or view another user's data directly.
3. Golf Club/Course information is shared data which can be entered by either individual users or staff in order to review, edit and/or maintain this information. The process would be: user enter the course information (if not already in the database) and then system can have data possibly reviewed regarding the course information, correct and augment if necessary, and then lock it so that users cannot corrupt the shared data.

Users can in one embodiment upload round/shot information from a spreadsheet or another file. Data can be extracted from it (simulating data entry via the screen). Information can be obtained from a mobile/GPS device. Further there can be provision for uploading user golf swing videos. Still further there can be provision to upload information from third party systems for analysis and tracking purposes.

While we have described herein a particular embodiment of a golfing aid, iris further envisaged that other embodiments of the invention could exhibit any number and combination of anyone of the features previously described. However, it is to be understood that any variations and modifications which can be made without departing from the spirit of the invention are included in the scope thereof. For example a very unique feature of the invention can be the ability to estimate (or predict) a user's golf score based on their practice results. For example, a user could hit shots during a skills test (or practice drill). The skills test would have the ability to obtain the dispersion or shots to hole number. The dispersion or shots to hole number can then be used to adjust the inputs to the what-if model so that the user can obtain an estimate of their golf score based on their current skill.

The invention claimed is:

1. A predictive golf aid for predicting best personal approach to a game of golf and thereby assisting to reduce shots per hole of a player consisting of:

a. a first input to a computer platform for receiving input of one or more of:
   i. distance of user from present position to hole in a game of golf;
   ii. distance to selected aiming position for a golf shot in the game of golf;
   iii. distance of resultant golf shot in the game of golf from the selected aimed position; and
   iv. distance of resultant golf shot in the game of golf from the hole;

b. at least a second input to the platform for inputting of a dispersion of the actual shot from an inputted planned shot;

c. the platform including a collator for receiving and automatically collating the input from the platform location of the first input on a plurality of holes in the game of golf;

d. the platform including a determinator in the form of a computerized process adapted to determine a computer-generated model for the particular user based on the collated input for a plurality of shots in one or more games of golf of the user;

e. a first output receiving from the platform in the form of a display or audible output for outputting the collated inputs;

f. a first what-if input to the platform for allowing input of a variable of the input such that the computerized model is modified to provide a hypothetical result based on the variable input in the determined model for that user;

g. a second output for outputting in real time the hypothetical what-if result;

h. a tertiary comparative input for inputting an input of one or more comparative users or benchmarks such that the model provides a comparative result based on the comparative input in the determined model for that user;

i. a third output for outputting the comparative result;

j. a fourth output for outputting a suggested training routine or improvement that has been determined by an improvement analyzer from any one or more of the first, second, third or fourth output; and k. at least one input of a dispersion of the actual shot from an inputted planned shot with the at least one input of a dispersion of shot from the planned shot being separately automatically determined for a game by comparison of the previous inputted distance to hole to the next inputted distance to hole with the at least one input of a dispersion of shot from the planned shot being separately automatically determined for a game by comparison of the previous inputted distance to hole to the next inputted distance to hole.

2. A predictive golf aid for collating input able to be provided in real time from a user to define a computerized model of play of the user whereby the computerized model is based on determination of number of shots to the hole in a game of golf, wherein the predictive golf aid consists of:

at least one input to a computer platform including one of said inputs adapted to receive inputted data of a real game of golf of a user able to be collected in real time of a golf game;

a collator receiving and automatically collating the input from the input on one or more holes in the game of golf to form a collated input;

a determinator for determining a set of parameters characteristic of the user, such that the determinator creates a model of the particular user based on at least the collated input;

one or more outputs for outputting results or information based on results from the determined model and a selected collated input;

a what-if input to the platform for allowing input of a variable of the input such that the computerized model is modified to provide a hypothetical result based on the variable input in the determined model for that user; and an output receiving from the platform in the form of a display or audible output for outputting the hypothetical what-if result in real time;

wherein a user can assess the model of play by the expected number of shots to the hole in a game of golf, and wherein the at least one input includes a dispersion of a shot from the planned shot of the actual shot from an inputted planned shot.

3. A predictive golf aid according to claim 2 wherein the selective input is a what-if input to the determined model for allowing input of a variable of the inputted data such that the model provides a hypothetical result based on the variable inputted data in the determined model for that user.

4. A predictive golf aid according to claim 3 wherein the what-if input is set by a user to define a score as a required goal with an associated output of a set of skill targets.

5. A predictive golf aid according to claim 3 including an input for receiving automatic GPS (global positioning satellite) position location for automatically determining position of user in a real game undertaking one or more shots so as to allow automatic determination of results of shots of player for input to the determinator for determining the model.

6. A predictive golf aid according to claim 2 wherein the what-if input to the determined model includes input data of an inputted planned shot and an actual result and provides a comparison of the actual shot from an inputted planned shot.

7. A predictive golf aid according to claim 2 including a further comparative input to the determinator for inputting an input of one or more comparative users or benchmarks such that the computerized model provides a comparative result based on the comparative input in the determined model for that user.

8. A predictive golf aid according to claim 2 including an output for outputting from the determined model a sensitivity identifier to identify the areas of a player's game which are sensitive to their score.

9. A predictive golf aid according to claim 8 including an input for inputting an alteration to a sensitivity identifier to identify the expected result of a player's game if such alteration occurred.

10. A predictive golf aid according to claim 9 including an output for outputting a suggested training routine or improvement that has been determined by an improvement analyzer based on the goal of the alteration to a sensitivity identifier to the input.

11. A predictive golf aid according to claim 2 including a collating input from a user to define a model of play of the user whereby the model is based on determination of number of shots to the hole in a game of golf.

12. A predictive golf aid according to claim 11 whereby the user specific model includes review of categories of distance of shots undertaken by the user in a game of golf.

13. A predictive golf aid according to claim 12 including the categories having ranges of distances of shots.

14. A predictive golf aid according to claim 13 including the ranges being general categories based on the likely dispersion of the shots due to the user's ability.

15. A predictive golf aid according to claim 14 including the ranges being predetermined due to skill of player such as ranges of 20 meters with dispersion variations of less than 10 meters for a highly skilled player while at the other end of the scale for casual players, the ranges are long shots, medium shots, short shots and putts.

16. A predictive golf aid according to claim 2 wherein the model can interpolate expected results of a user on a particular course or for a remainder of a game based on an input inputting a correlation of holes on one or more golf courses.

17. A predictive golf aid according to claim 16 wherein the model compares courses using predetermined course index details.

18. A predictive golf aid according to claim 2 wherein the at least one input includes a dispersion of shot from the planned shot being separately automatically determined during the game by comparison of the previous inputted distance to hole to the next inputted distance to hole.

19. A predictive golf aid according to claim 2 including the model determining a dispersion element of a shot on the model of a user by an input receiving from a player an expected distance to selected aiming position for a golf shot in the game of golf and comparing to distance of resultant golf shot in the game of golf from the selected aimed position.

20. A predictive golf aid according to claim 19 including the model having a dispersion element for a plurality of categories of shots.

21. A predictive golf aid for collating input able to be provided in real time from a user to define a model of play of the user whereby the model is based on determination of number of shots to the hole in a game of golf, wherein the golf aid consists of:

at least one input comprising a platform for inputting data including one of said inputs receiving inputted data of a real game of golf of a user able to be collected in real time of a golf game;

a collator receiving and automatically collating the input from the input on one or more holes in the game of golf to form a collated input;

a determinator in the form of a computerized process adapted to determine a set of parameters characteristic of the user, such that the determinator creates a model of the particular user based on at least the collated input;

one or more outputs for outputting results or information based on results from the determined model and a selected collated input;

a what-if input structure allowing input of a variable of the input such that the model provides a hypothetical result based on the variable input in the determined model for that user;

an output being a display of the what-if input after an analysis of an input corresponding to a proposed shot to be displayed allowing outputting the hypothetical what-if result; and a collating input for collating input from a user to define a model of play of the user whereby the model is based on determination of number of shots to the hole in a game of golf, wherein the user specific model includes review of categories of distance of shots undertaken by the user in a game of golf, the categories including having ranges of distances of shots based on the likely dispersion of the shots due to the user's ability, or ranges being predetermined due to skill of player such as ranges of 20 meters with dispersion variations of less than 10 meters for a highly skilled player while at the other end of the scale for casual players, the ranges are long shots, medium shots, short shots and putts with the result that a user can assess the model of play by the expected number of shots to the hole in a game of golf.

22. A predictive golf aid, for collating input from a user to define a model of play of the user whereby the model is based on determination of number of shots to the hole in a game of golf, wherein the golf aid consists of:

at least one input to a computer platform including one of said inputs receiving inputted data of a real game of golf of a user able to be collected in real time of a golf game;

a collator receiving and automatically collating the input from the input means on one or more holes in the game of golf to form a collated input;

a determinator determining a set of parameters characteristic of the user, such that the determinator creates a model of the particular user based on at least the collated input;

one or more outputs for outputting results or information based on results from the determined model and a selected collated input;

a what-if input to the determined model for allowing input of a variable of the input data such that the model provides a hypothetical result based on the variable input data in the determined model for that user;

an output receiving from the platform in the form of a display or audible output for outputting the hypothetical what-if result; and an input adapted to receive automatic GPS (global positioning satellite) position location for automatically determining position of user in a real game undertaking one or more shots so as to allow automatic determination of results of shots of player for input to the determinator for determining the model;

wherein the user specific model includes review of categories of distance of shots undertaken by the user in a game of golf, the categories including having ranges of distances of shots being predetermined due to skill of player such as ranges of 20 meters with dispersion variations of less than 10 meters for a highly skilled player while at the other end of the scale for casual players, the ranges are long shots, medium shots, short shots and putts with the result that a user can assess the model of play by the expected number of shots to the hole in a game of golf.

23. A predictive golf aid consisting of:

a. a first input to a computer platform for receiving input of one or more of:
   i. distance of user from present position to hole in a game of golf;
   ii. distance to selected aiming position for a golf shot in the game of golf;
   iii. distance of resultant golf shot in the game of golf from the selected aimed position; and
   iv. distance of resultant golf shot in the game of golf from the hole;

b. a collator for receiving and automatically collating the input from the platform location of the input on a plurality of holes in the game of golf;

c. a first output received from the platform for outputting the collated inputs;

d. a determinator for determining a computer-generated model for the particular-user based on the collated input for a plurality of shots in one or more games of golf of the user;

e. a secondary what-if input to the platform for allowing input of a variable of the input such that the model provides a hypothetical result based on the variable input in the determined model for that user;

f. a second output for outputting the hypothetical what-if result;

g. a tertiary comparative input for inputting an input of one or more comparative users or benchmarks such that the model provides a comparative result based on the comparative input in the determined model for that user;

h. a third output for outputting comparative result;

i. a fourth output for outputting a suggested training routine or improvement that has been determined by an improvement analyzer from any one or more of the first, second, third or fourth output;

j. at least one input of a dispersion of the actual shot from an inputted planned shot with the at least one input of a dispersion of shot from the planned shot being separately automatically determined for a game by comparison of the previous inputted distance to hole to the next inputted distance to hole; and k. a second input to the platform adapted to receive automatic GPS (global positioning satellite) position location for automatically determining position of user in a real game undertaking one or more shots so as to allow automatic determination of results of shots of player for input to the determinator for determining the model.

* * * * *